US010995551B2

(12) United States Patent
Luoma et al.

(10) Patent No.: US 10,995,551 B2
(45) Date of Patent: May 4, 2021

(54) DEVICE FOR NOISE DAMPING AND ROCK DRILLING RIG

(71) Applicant: SANDVIK MINING AND CONSTRUCTION OY, Tampere (FI)

(72) Inventors: Lassi Luoma, Tampere (FI); Sampo Sivula, Tarttila (FI)

(73) Assignee: Sandvik Mining and Construction Oy, Tampere (FI)

( * ) Notice: Subject to any disclaimer, the term of this patent is extended or adjusted under 35 U.S.C. 154(b) by 0 days.

(21) Appl. No.: 16/543,682

(22) Filed: Aug. 19, 2019

(65) Prior Publication Data

US 2020/0058281 A1 Feb. 20, 2020

(30) Foreign Application Priority Data

Aug. 20, 2018 (EP) ..... 18189797

(51) Int. Cl.
*E21B 7/02* (2006.01)
*G10K 11/16* (2006.01)

(52) U.S. Cl.
CPC ..... *E21B 7/025* (2013.01); *G10K 11/16* (2013.01)

(58) Field of Classification Search
CPC ..... E21B 7/025
See application file for complete search history.

(56) References Cited

U.S. PATENT DOCUMENTS

| | | | | |
|---|---|---|---|---|
| 4,671,366 | A | 6/1987 | Uitto et al. | |
| 6,199,656 | B1 * | 3/2001 | Vento | E21B 7/025 173/219 |
| 2012/0205190 | A1 * | 8/2012 | Luoma | E21B 7/025 181/208 |

FOREIGN PATENT DOCUMENTS

| | | | |
|---|---|---|---|
| DE | 1905981 | U | 12/1964 |
| DE | 7312658 | U | 7/1973 |
| DE | 3229998 | A1 | 2/1984 |
| WO | 2008/007820 | A1 | 1/2008 |
| WO | 2011/029993 | A1 | 3/2011 |

* cited by examiner

*Primary Examiner* — Kristyn A Hall
(74) *Attorney, Agent, or Firm* — Corinne R. Gorski

(57) ABSTRACT

A device for dampening noise and a rock drilling rig. The noise dampening device includes a skin structure and a frame, which are separate elements. The skin structure is configured to form a space for receiving at least a part of the rock drilling unit and includes several noise dampening panels, which are mounted to the frame in a removable manner.

11 Claims, 4 Drawing Sheets

DEVICE FOR NOISE DAMPING AND ROCK DRILLING RIG

RELATED APPLICATION DATA

This application claims priority under 35 U.S.C. § 119 to EP Patent Application No. 18189797.6, filed on Aug. 20, 2018, which the entirety thereof is incorporated herein by reference.

TECHNICAL FIELD

The invention relates to a device for dampening noise caused in rock drilling. The device is arranged around a drilling unit of a rock drilling rig. The invention further relates to a rock drilling rig provided with a noise dampening device.

BACKGROUND

In mines, construction sites and at other work areas different type of rock drilling rigs are used for drilling holes for different purposes. The rock drilling rigs are provided with one or more booms and rock drilling units are arranged at distal ends of the booms for drilling the drill holes.

When rock is drilled, noise is spread to the surroundings. The noise is produced mainly by an impact device of a rock drilling machine percussing on an impact head of a drilling tool and the tool impacting on the rock. In order to prevent problems caused by the noise, attempts have been made to solve the issue, particularly in surface drilling, by using various noise damping housings around the feed beam and the rock drilling machine. However, the present noise dampening solutions have shown to contain some disadvantages regarding their complicated, expensive and clumsy structure.

SUMMARY

An object of the invention is to provide a novel and improved device for reducing drilling sound. The invention further relates to a novel an improved rock drilling rig.

An idea of the disclosed solution is that the noise dampening solution is designed for rock drilling units and includes a skin structure and a frame, which are separate elements. The skin structure surrounds the rock drilling unit at least partly and thereby prevents free spreading of noise to the surroundings. The frame provides support for the skin structure and allows mounting to a feed beam of the drilling unit. Further, the skin structure comprises several noise dampening panels, which are separately fastened to the frame. Removable mounting between the panels and the frame allows individual handling of the panels.

An advantage of the disclosed solution is that since the structure comprises several separately mountable and dismountable noise panels, the structure may be modified later and damaged panels may be easily changed. Because the frame and the skin structure are separate elements, the structure may be simple and easy to manufacture. On the other hand, the skin structure and the structure of the frame may both be optimized. Compared to complex integrated noise housings, the disclosed solution provides a flexible and light-weight solution.

A further advantage is that the skin structure consists of several noise dampening panels, which are simple in structure and their size is limited. This kind of panels are easy to manufacture and no special production technology is needed. Since the panels are mounted in a removable manner, selected panels can also be dismounted for service and repair work.

According to an embodiment, the frame of the noise dampening device is one single unity extending longitudinally from a front end portion to a rear end portion of the device. This way the frame has one piece structure instead of having several separate frame parts at a distance from each other. However, the single piece frame may formed of several frame pieces which are connected to each other by means of weld joints, screw mounting, rivets or corresponding coupling techniques. Thanks to the single piece structure the frame may be rigid and mounting of the frame is easy and quick. The structure of the frame and its mounting points may be designed according to configuration of the rock drilling unit.

According to an embodiment, the frame of the noise dampening device comprises a rack formed of metallic bars or tubes. The rack has at least two parallel longitudinal bars connected to each other, and several transverse supports. The transverse supports may serve as fastening legs for the rack or they may serve alternatively, or in addition to, as support surfaces for mounting side panels to the rack. Further, the rack is provided with several fastening points for fastening the panels mechanically to the rack. The rack may comprise several steel bars or tubes which are bent and connected by weld joints to each other.

According to an embodiment, the frame of the noise protector includes a rack having an upper frame having rectangular shape and several elongated supporting elements arranged transversally relative to the longitudinal direction of the frame, and wherein upper ends of the supports are fastened immovably to the upper frame.

According to an embodiment, the fastening points of the frame or rack are configured to receive fastening elements, such as fastening screws, pins or rivets, of the panels. In other words, between the rack and the noise dampening panels are mounting means allowing mounting and dismounting the panels.

According to an embodiment, the skin structure has at least three separate panels. According to an embodiment, the number of separate panels is at least six.

According to an embodiment, the panels are provided with sealing elements at their edges. The sealing element may be a sealing strip with desired profile and being formed of rubber-like material, for example.

According to an embodiment, the bottom of the feed beam is not entirely surrounded by the skin structure. In other words, the skin structure may surround the rock drilling unit partly so that one surface of the feed beam is outside it. Thus, the noise protector is easier to support to the feed beam, and further, movable connection between the rock drilling unit and a drilling boom is easier to arrange.

According to an embodiment, the skin structure includes at least two successive side panels on both longitudinal sides of the skin structure, at least one front panel at front end portion, and at least one rear panel at rear end portion of the skin structure. The skin structure also includes at least two successive top panels on longitudinal top side of the skin structure.

According to an embodiment, at least one of the noise damping panels has a transparent section or window allowing monitoring operation of the drilling unit. The monitoring window may be located at the top side of the skin structure. However, it is relatively easy to arrange windows to any other location where monitoring is needed.

According to an embodiment, the skin structure includes at least one panel mounted by means of hinges to the frame. Alternatively, at least one panel may be fastened to the frame by a quick coupling means. The mentioned openable panels allow easy access to an inner space of the noise protector. The openable panel, which serves as a lid and may be provided with sensing means for detecting opening of the lid for security purposes.

According to an embodiment, at a rear portion of the skin structure is at least one rear panel provided with an opening allowing the generated noise to spread through the opening out of the space limited by the skin structure. It has been noted in practical tests that the rear opening has a positive impact on the noise dampening. The rock drilling unit is, at least in surface drilling solutions, typically positioned during the operation so that the rear opening is facing upwards, whereby the noise discharging from the inside causes no harm.

According to an embodiment, the shape of the opening of the rear panel disclosed in the previous embodiment is substantially rectangular and the structure of the rear panel is configured to surround the opening from three sides. It has been found in practical tests that the rectangular shape is advantageous for the rear opening.

According to an embodiment, the skin structure is provided with at least two longitudinally successive rear panels at longitudinal distance from each other. Furthermore, each of the rear panels is provided with the opening disclosed as in previous embodiments. When several rear panels with openings form compartments at the rear part, the discharging noise can be dampened even more effectively.

According to an embodiment, the panels are fastened to the frame by mechanical fastening elements. The mechanical mounting of the panels may be based on screw mounting, which is safe, reliable and cost-effective. Alternatively, it may be possible to utilize shape locking elements and quick coupling means for connecting the panels.

According to an embodiment, each of the panels includes an outer layer and at least one additional layer connected on an inner side of the outer layer. The outer layer is made of material impermeable to air and the at least one additional layer includes noise dampening material. In other words, the panels may have two, three or four superimposed material layers. The outer layer may serve as a main load carrying structure and protective cover, and the one or more inner layers may serve as noise dampeners.

According to an embodiment, at least part of the noise dampening panels has three superimposed layers, an outer layer, and inner layer and a middle layer. The outer layer is formed of metallic sheet material, the inner layer includes light-weight sound absorbing element, and the middle layer includes damping mass applied directly on an inner surface side of the mentioned outer layer.

According to an embodiment, at least part of the noise dampening panels may have a two-layer configuration having an outer layer made of plastic material or fiber reinforced composite, for example, and an inner layer made of sound absorbing material. When the outer layer is made of non-metallic material, vibrations of the structure are easier to handle and one absorbing layer may be sufficient. However, also some other non-metallic materials, such as some composite structures, may require use of damping mass. If internal damping properties of material of the outer layer are good, then no damping mass is needed. That is because propagation of vibrations in such material is poor. Examples of such material are different plastics and rubber-like materials.

According to an embodiment, the sound absorbing element of the inner layer is mechanically fastened to the outer layer, which forms a body for the panel. The mechanical fastening element may be a pin fastened to an inner surface of the inner layer and which is protruding inwards. The pin may be a screw, for example. However, it may also be possible to fasten the absorbing element by using glue bonding.

According to an embodiment, at least some of the panels may be provided with either the sound absorbing element or with the damping mass. Then, the skin structure may have small sized panels or some specially shaped pieces, which are provided with only one sound absorbing material or system fastened on the inner surface side of the impermeable outer layer of the panel.

According to an embodiment, the inner layer is made of sound absorbing foam material, which has sheet-like or plate-like configuration. Thickness of the foam plate may be 20-50 mm, for example. The foam plate is light in weight, is relatively easily bendable and also fastening of such plate is easy.

According to an embodiment, the inner layer may be formed of foam plate material of which consists of closed cell polyethylene foam. The foam plate is provided with cells that are subsequently opened through the manufacturing process. As a result of the opened cells the material has highly efficient sound absorbent properties.

According to an embodiment, the inner layer may be formed of any other acoustic foam panel suitable for the purpose and the harsh circumstances of the rock drilling.

According to an embodiment, the damping mass, which may serve as the middle layer or the layer applied directly on the inner side of the outer layer, may be of viscoelastic damping compound. The damping mass may be applied on the inner surface of the outer layer by spraying or rolling, for example. Purpose of the viscoelastic damping compound is to reduce noise radiated by vibration or shock excited metal surfaces and panels by imparting vibration damping to metal or other hard non-metallic, shifting the peaks of the generated sound by lowering the natural frequency, and increasing the sound transmission loss.

According to an embodiment, the outer layer of the panel may be made of aluminum alloy plate, whereby it is light in weight, durable and corrosion resistant.

According to an embodiment, the noise protector is provided with a pre-designed substitute system wherein at least some of the noise dampening plates are changeable to plates with corresponding dimensions and fastening means but having grating-like configuration with several through openings. Thereby, the device is changeable from the noise damping device to a protective cage without any changes to the frame. The substitute system increases operational flexibility when best suited configuration may be selected and easily implemented.

According to an embodiment, the substitute system discloses in the previous embodiment provides modularity for the device, which can be initially equipped either with noise plates or grating plates depending on the need. Further, the initial setting may be changed later since the frame suits as a general fastening base for both type of plates. In other words, at least part of the separate panels of the skin structure are substitutable with other type of panels, whereby the nature of the device is easily changeable.

According to an embodiment, the solution may include a method of forming a device for dampening noise produced in rock drilling. The method includes features disclosed above. The solution may also include another method of dampening noise in rock drilling and utilizing the disclosed noise dampener in the method.

The foregoing summary, as well as the following detailed description of the embodiments, will be better understood when read in conjunction with the appended drawings. It should be understood that the embodiments depicted are not limited to the precise arrangements and instrumentalities shown.

BRIEF DESCRIPTION OF THE FIGURES

For the sake of clarity, the figures show some embodiments of the disclosed solution in a simplified manner. In the figures, like reference numerals identify like elements.

DETAILED DESCRIPTION

Figure 1:
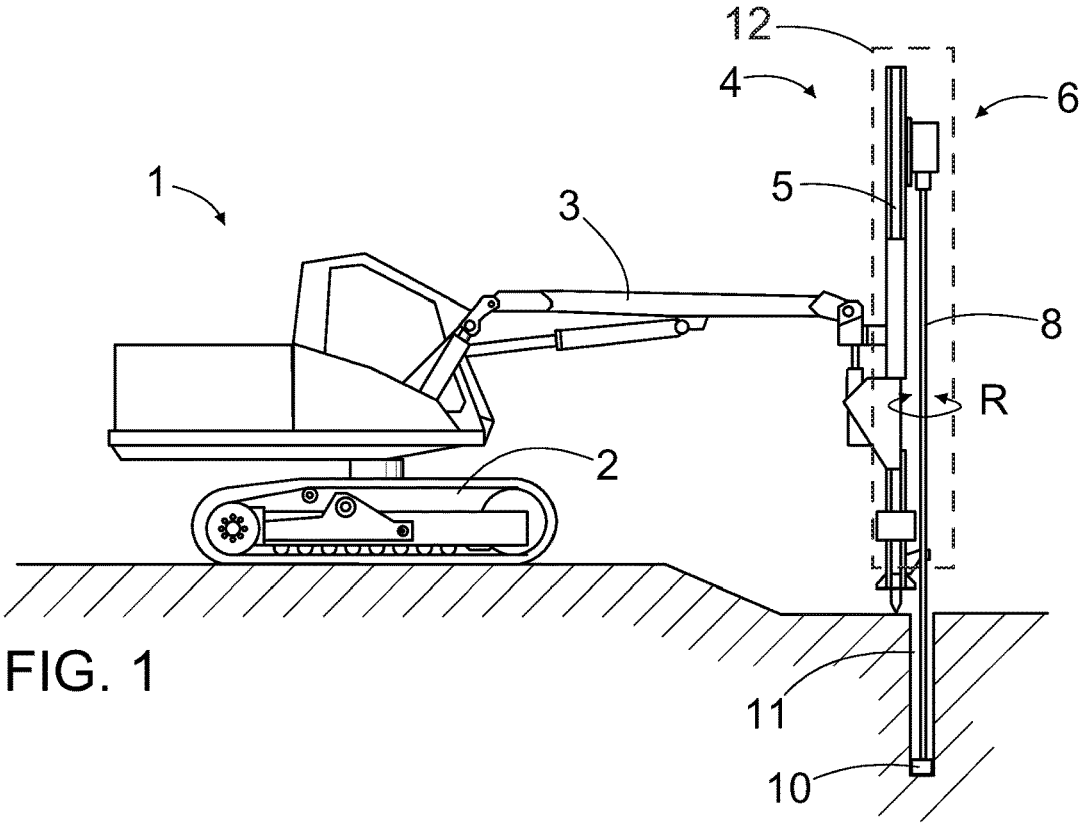
FIG. 1 is a schematic side view of a rock drilling rig for surface drilling provided with a noise protector.

FIG. 1 shows a rock drilling rig 1. The rock drilling rig 1 includes a movable carrier 2 and at least one boom 3 connected to the carrier 2. At a distal end portion of the boom 3 is a drilling unit 4. The drilling unit 4 may include a feed beam 5 and a rock drilling machine 6 supported thereon. The rock drilling machine 6 may include a rotating unit for rotating a tool 8.

Further, the rock drilling machine 6 includes an impact device, which generates impact pulses for a drill bit 10 in order to form a drill hole 11. Since operation of the rock drilling machine 6 causes noise, the rock drilling unit is surrounded at least partly with a noise dampening device 12. The noise dampener or protector will be described further herein.

It should be appreciated that the disclosed noise dampening solution may also be used for other type of drilling rigs and drilling machines. Thereby, the disclosed solution may be implemented in rock drilling rigs intended for underground drilling and may be implemented also in rotary and DTH drilling, as well as in exploration drilling.

Figure 2:
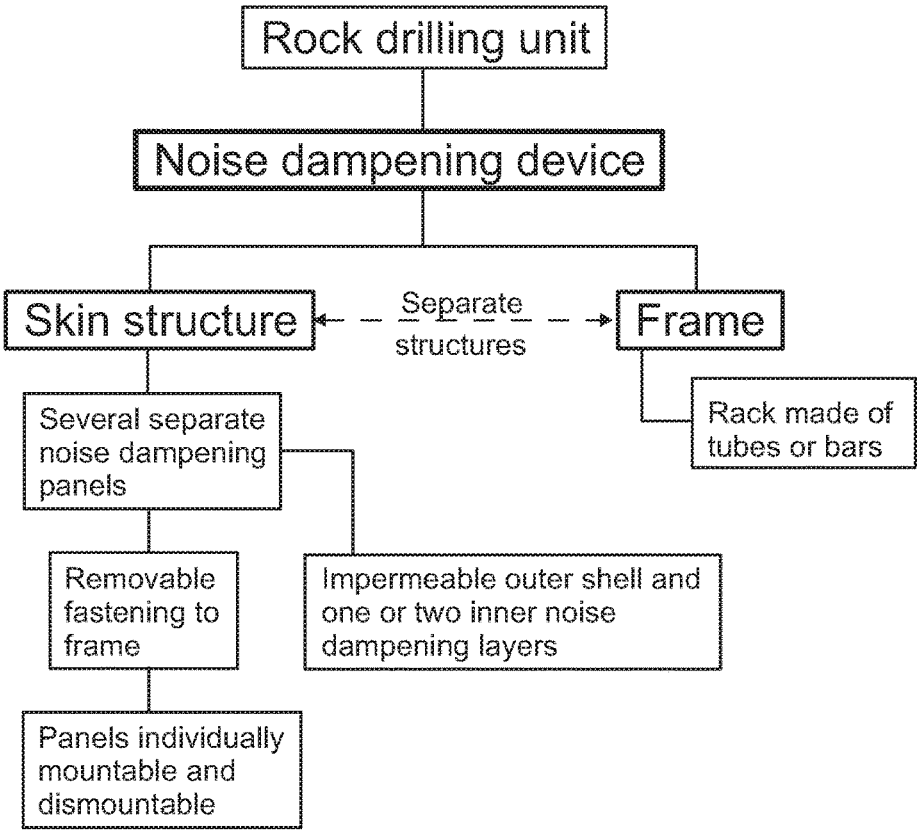
FIG. 2 is a schematic diagram of a noise dampening device of the rock drilling rig.
Figure 3:
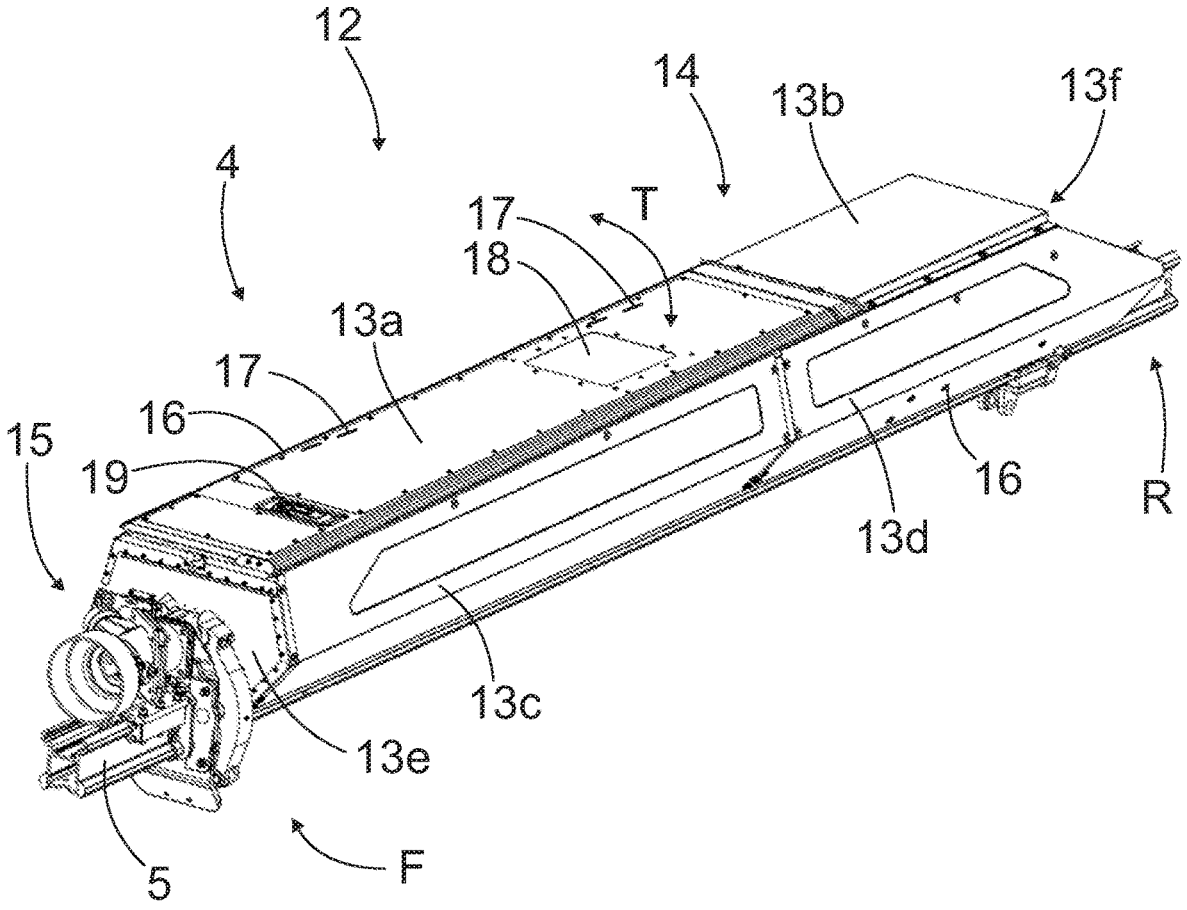
FIG. 3 is a schematic view of a noise dampening structure arranged to partly cover a rock drilling unit.

FIG. 2 discloses some features of a noise dampening device intended for rock drilling and is described herein. FIG. 3 discloses a noise dampening device 12, which has several removable noise dampening panels 13*a*-13*f*, which form together a skin structure 14 and an inner space inside which a rock drilling machine is mounted and which at least partly covers the feed beam 5. At a front end F of drilling unit 4 may be devices 15 or auxiliary components operation of which does not cause noise, therefore they may be left outside the noise protector 12.

The dampening panels 13 may be fastened to a separate frame by means of fastening elements 16, such as screws or quick coupling elements. Further, some of the panels 13 may be coupled by means of hinges 17 so that they may be turned (T) between open and close positions. The skin structure 14 may have two or more longitudinally successive top panels 13*a* and 13*b*, two or more longitudinally successive side panels 13*c* and 13*d* on both sides of the noise protector 12, a front panel 13*e*, and further, one or more rear panels 13*f* at a rear end portion R of the noise dampener 12. Further, one or more panels 13 may be provided with transparent monitoring sections 18. Alternatively, the panels 13 may include openable small lids facilitating maintenance and monitoring, for example. Further, instead of fastening screws or corresponding elements, quick coupling locks 19 may be used for fastening the panels 13.

Figure 4:
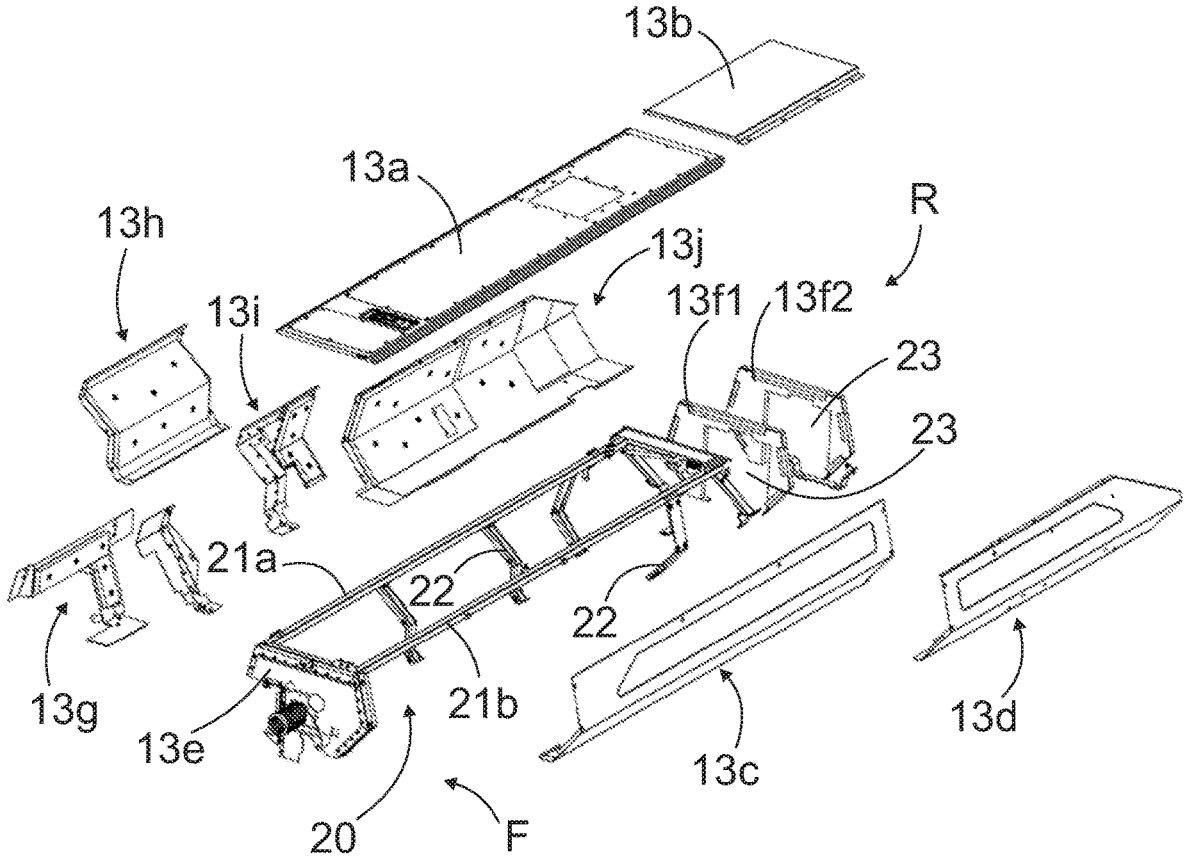
FIG. 4 is a schematic and exploded view of a noise dampening device of the rock drilling rig.

As shown in FIG. 4, a skin structure 14 may include several independent noise dampening panels 13*a*-13*j*, and a separate frame 20 for supporting the skin structure 14 and for connecting it to a feed beam. The frame 20 may be a rack type structure having two longitudinal bars 21*a*, 21*b* and several transverse supports 22 or support elements. The supports 22 may connect the frame to the feed beam or other components of the drilling unit and they may also serve as fastening surface for the panels. Alternatively, the supports 22 are intended only for fastening the panels and the frame 20 is mounted by using separate fastening bars, elements or devices. As it is shown in FIG. 4, at the rear end R of the skin structure 14 may be two rear panels 13*f*1 and 13*f*2 which may both have an opening 23, which may be shaped to be rectangular. The rear panels may be arranged successively at a longitudinal distance from each other.

Figure 5:
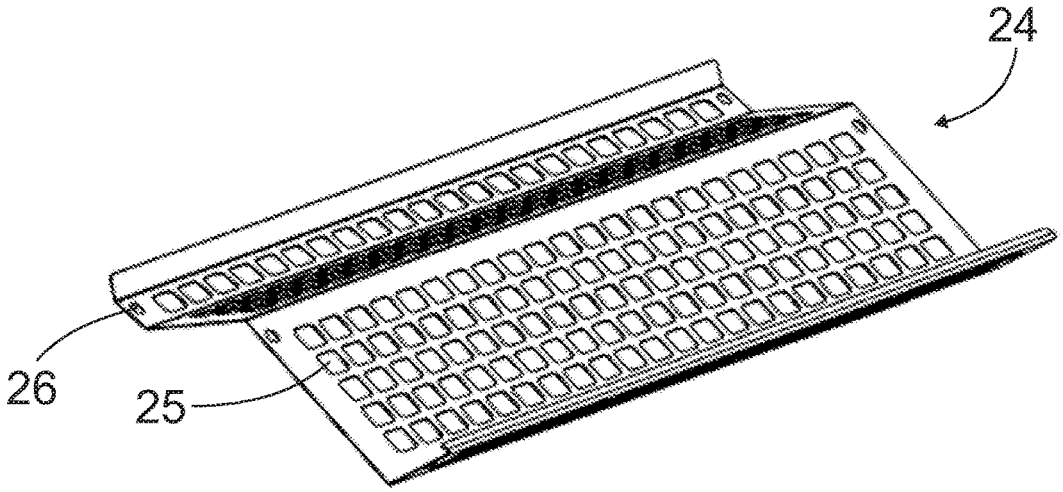
FIG. 5 is a schematic view of a protection panel of the rock drilling rig.

FIG. 5 discloses a substitute panel 24, which may be mounted to a frame of a noise protector when no noise dampening is needed. The panel 24 may have a grating-like configuration whereby it includes several through openings 25. The panel 24 may serve as mechanical protector preventing access to rotating and moving machine elements. The panel 24 may be dimensioned similarly as noise dampening panels and may have similar fastening openings 26 or fastening means such as noise dampening panels, whereby the panels are compatible with the frame.

Figure 6A:
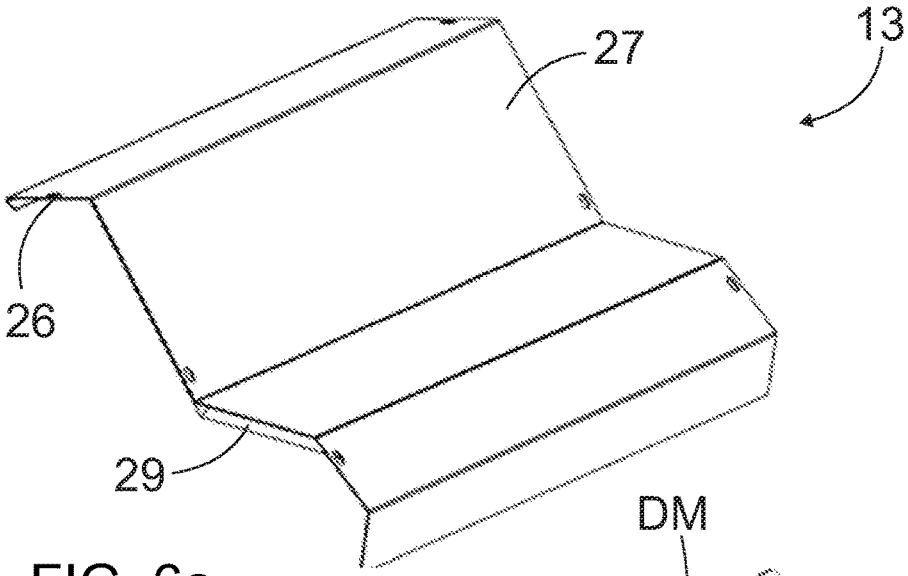
FIG. 6*a* is a schematic view of a noise dampening panel seen from an outer surface side and FIG. 6*b* shows the same panel from an inner surface side.
Figure 6B:
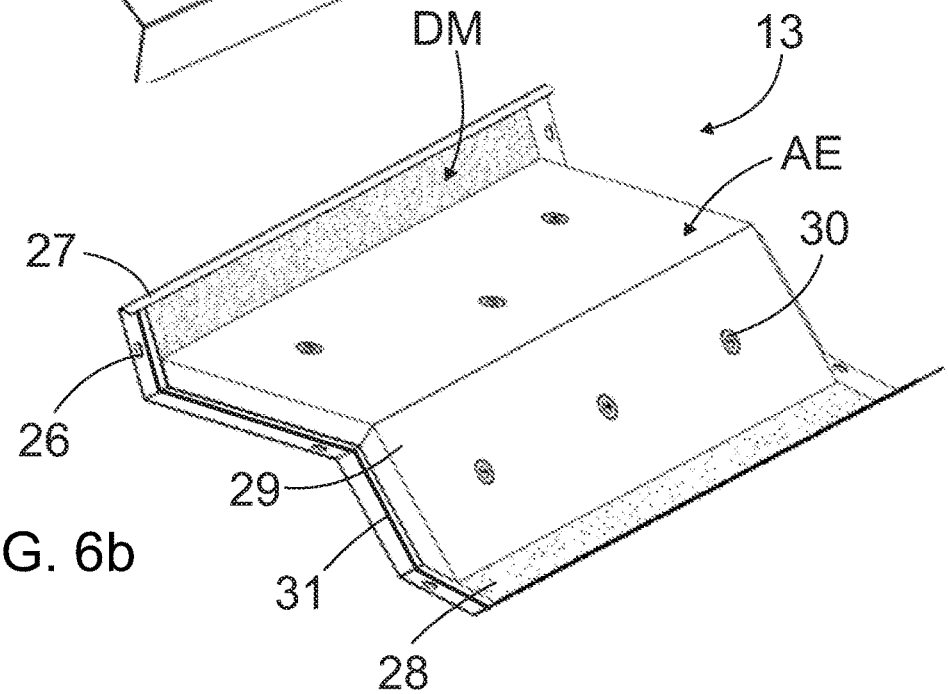

FIGS. 6*a* and 6*b* disclose a noise dampening panel 13 having an outer layer 27, an inner layer 28 and a middle layer 29. The outer layer 27 may be made of aluminium alloy and it may be shaped into desired form by means of bending and other sheet machining techniques. On an inner surface of the outer layer 27 there may be applied a damping mass DM, which forms the aforementioned middle layer 29. A light-weight absorbing element AE may be mounted to the outer layer 27 by mechanical fastening elements or pins 30. Further, edge areas of the panel 13 may be provided with seals 31.

Although the present embodiment(s) has been described in relation to particular aspects thereof, many other variations and modifications and other uses will become apparent to those skilled in the art. It is preferred therefore, that the present embodiment(s) be limited not by the specific disclosure herein, but only by the appended claims.

What is claimed is:

1. A device for dampening noise of a rock drilling unit, the device comprising:

a skin structure configured to form a space for receiving the rock drilling unit at least partly; and a frame arranged for fastening the skin structure to a feed beam of the drilling unit, wherein the frame and the skin structure are separate elements, the skin structure including several separate noise dampening panels fastened to the frame in a removable manner, wherein each of the panels includes an outer layer and at least one additional layer connected on an inner side of the outer layer, the outer layer being made of material impermeable to air and the at least one additional layer includes a noise dampening material, and each of the panels being individually mountable and dismountable, and wherein the frame includes a rack formed of metallic bars or tubes, the rack including at least two parallel longitudinal bars connected to each other and several transverse supports, wherein the rack is provided with several fastening points for fastening the panels mechanically to the rack.

2. The device as claimed in claim 1, wherein at least one of the noise damping panels includes a transparent section or window allowing monitoring of an operation of the drilling unit, each panel being individually mountable and dismountable.

3. The device as claimed in claim 1, wherein the frame extends longitudinally from a front end portion to a rear end portion of the device.

4. The device as claimed in claim 1, wherein the skin structure includes at least three separate panels.

5. The device as claimed in claim 1, wherein the skin structure includes at least two successive side panels on longitudinal sides of the skin structure, at least one front panel located at a front end portion of the device, at least one rear panel located at a rear end portion of the skin structure, and at least two successive top panels on a top side of the skin structure.

6. The device as claimed in claim 1, wherein the skin structure includes at least one panel mounted by hinges to the frame.

7. The device as claimed in claim 1, wherein at a rear portion of the skin structure is at least one rear panel provided with an opening arranged to allow generated noise to spread through the opening out of the space limited by the skin structure.

8. The device as claimed in claim 1, wherein the panels are fastened to the frame by mechanical fastening elements.

9. The device as claimed in claim 1, wherein at least some of the noise dampening plates are removable, and further comprising a plurality of plates having through openings forming a grating-like configuration, the plurality of plates having corresponding dimensions and fastening means to the removable noise dampening plates and being interchangeable therewith, to form a protective cage without any changes to the frame.

10. A device for dampening noise of a rock drilling unit, the device comprising:

a skin structure configured to form a space for receiving the rock drilling unit at least partly; and a frame arranged for fastening the skin structure to a feed beam of the drilling unit, wherein the frame and the skin structure are separate elements, the skin structure including several separate noise dampening panels fastened to the frame in a removable manner, wherein at least part of each of the noise dampening panels has three superimposed layers including an outer layer, and inner layer and a middle layer, wherein the outer layer is formed of metallic sheet material, the inner layer light-weight including a sound absorbing element, and the middle layer including a damping mass applied directly on an inner surface side of the mentioned outer layer, and each of the panels being individually mountable and dismountable, and wherein the frame includes a rack formed of metallic bars or tubes, the rack including at least two parallel longitudinal bars connected to each other and several transverse supports, wherein the rack is provided with several fastening points for fastening the panels mechanically to the rack.

11. A rock drilling rig comprising:

a movable carrier;

at least one drilling boom;

a drilling unit at a distal end part of the drilling boom, wherein the drilling unit includes a feed beam and a rock drilling machine-supported movably on the feed beam; and a noise damping device according to claim 1, the skin structure surrounding at least partly the drilling unit and the frame supporting the device on the drilling unit.

* * * * *